US011386862B2

(12) United States Patent
Shan

(10) Patent No.: US 11,386,862 B2
(45) Date of Patent: Jul. 12, 2022

(54) DRIVE METHOD, DISPLAY PANEL AND DRIVING CIRCUIT

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 574 days.

(21) Appl. No.: 16/461,369

(22) PCT Filed: Feb. 20, 2019

(86) PCT No.: PCT/CN2019/075516

§ 371 (c)(1),
(2) Date: May 16, 2019

(87) PCT Pub. No.: WO2020/155217

PCT Pub. Date: Aug. 6, 2020

(65) Prior Publication Data

US 2021/0366424 A1 Nov. 25, 2021

(30) Foreign Application Priority Data

Jan. 30, 2019 (CN) ..... 201910089130.X

(51) Int. Cl.
*G09G 3/36* (2006.01)

(52) U.S. Cl.
CPC ... *G09G 3/3677* (2013.01); *G09G 2300/0439* (2013.01); *G09G 2320/0247* (2013.01)

(58) Field of Classification Search
CPC ..... G09G 3/3677; G09G 2300/0439; G09G 2320/0247
See application file for complete search history.

(56) References Cited

U.S. PATENT DOCUMENTS

2003/0063074 A1* 4/2003 Kumagawa ..... G09G 3/3659 345/204
2007/0146593 A1* 6/2007 Ino ..... G02F 1/133555 349/114

(Continued)

FOREIGN PATENT DOCUMENTS

CN 1284709 A 2/2001
CN 101216645 A 7/2008

(Continued)

OTHER PUBLICATIONS

International Search Report issued in corresponding International application No. PCT/CN2019/075516, dated Oct. 8, 2019 (8 pages).

(Continued)

*Primary Examiner* — David Tung

(57) ABSTRACT

The present application discloses a driving method, a display panel and a driving circuit. The driving method is applied to the display panel, and includes a step of outputting a gate driving signal to a corresponding gate line of the display panel. A signal period of the gate driving signal includes a hold time, an open time, and a first pull-down time adjacent to the open time. The gate driving signal is in a first low level within the hold time, in a high level at the open time, and in a second low level within the first pull-down time, where the second low level is lower than the first low level.

12 Claims, 5 Drawing Sheets

(56) References Cited

U.S. PATENT DOCUMENTS

| | | | | |
|---|---|---|---|---|
| 2009/0174639 | A1* | 7/2009 | Chung | G09G 3/3659 345/88 |
| 2019/0067329 | A1* | 2/2019 | Hou | G09G 3/3685 |
| 2019/0086750 | A1* | 3/2019 | Han | H01L 27/124 |

FOREIGN PATENT DOCUMENTS

| | | | |
|---|---|---|---|
| CN | 101281330 | A | 10/2008 |
| CN | 102054459 | A | 5/2011 |
| CN | 102799037 | A | 11/2012 |
| CN | 106297715 | A | 1/2017 |
| CN | 107402486 | A | 11/2017 |
| CN | 109116641 | A | 1/2019 |
| JP | 10104578 | A | 4/1998 |

OTHER PUBLICATIONS

First Office Action from China patent office in a counterpart Chinese patent Application 201910089130.X, dated Nov. 28, 2019 (16 pages).

Second Office Action from China patent office in a counterpart Chinese patent Application 201910089130.X, dated Jun. 4, 2020 (13 pages).

Written Opinion of the International Searching Authority for No. PCT/CN2019/075516.

* cited by examiner

DRIVE METHOD, DISPLAY PANEL AND DRIVING CIRCUIT

The present application claims priority to the Chinese Patent Application No. CN201910089130.X, filed with the Chinese Patent Office on Jan. 30, 2019, and entitled "DRIVING METHOD, DISPLAY PANEL AND DRIVING CIRCUIT", which is incorporated herein by reference in its entirety.

TECHNICAL FIELD

The present application relates to the technical field of display, and in particular, to a driving method, a display panel and a driving circuit.

BACKGROUND

The statements herein merely provide background information related to the present application and do not necessarily constitute the prior art.

With the development and advancement of technologies, flat panel displays have become mainstream products of displays due to their thin bodies, power-saving and low radiation, and thus have been widely used. The flat panel displays include Thin Film Transistor-Liquid Crystal Displays (TFT-LCDs), Organic Light-Emitting Diode (OLED) displays, etc. The TFT-LCDs control the rotation direction of liquid crystal molecules to refract light of a backlight module to generate a picture, and has many advantages such as thin bodies, power-saving and no radiation. Moreover, the OLED displays are prepared by OLEDs, and have many advantages such as self-illumination, short response time, high definition and contrast, and can realize flexible display and large-area full-color display.

In the use of liquid crystal displays, the definition and stability of the display picture are an important problem that we've been working on. The picture is often affected by the driving voltage, resulting in some flickers. Such a phenomenon has to be settled urgently.

SUMMARY

To achieve the foregoing objective, the present application provides a driving method, a display panel and a driving circuit capable of solving display picture flickers.

The present application further discloses a driving method applied to a display panel, the display panel including: a plurality of data lines, a plurality of gate lines, and a plurality of pixels; the gate lines are intersected with the data lines, the plurality of pixels is respectively driven by corresponding data lines and gate lines, and each of the plurality of pixels includes a corresponding pixel electrode; the driving method includes a step of outputting a gate driving signal to a corresponding gate line of the display panel; where a signal period of the gate driving signal includes a hold time, an open time, and a first pull-down time adjacent to the open time, the gate driving signal is in a first low level within the hold time, the gate driving signal is in a high level at the open time, the gate driving signal is in a second low level within the first pull-down time, and a voltage value of the second low level is lower than a voltage value of the first low level.

Optionally, the first pull-down time is before the open time, a signal period of the gate driving signal further includes a second pull-down time after the open time, the gate driving signal is in a third low level within the second pull-down time, and a voltage value of the third low level is lower than the voltage value of the first low level.

Optionally, the first pull-down time and the open time are equal in duration.

Optionally, the first pull-down time and the open time are equal in duration; and a gate driving signal of a current gate line corresponds to the first pull-down time when a gate driving signal of a previous gate line corresponds to the open time.

Optionally, the open time and the second pull-down time are equal in duration.

Optionally, the open time and the second pull-down time are equal in duration; and the gate driving signal of the current gate line corresponds to the open time when the gate driving signal of the previous gate line corresponds to the second pull-down time.

Optionally, the voltage value of the second low level is equal to the voltage value of the third low level.

Optionally, each pixel includes a pixel electrode, a same gate line is connected to two adjacent pixels to form a pixel group, and the pixel group includes a first pixel and a second pixel connected to different data lines.

Optionally, a pixel electrode of the first pixel of the pixel group overlaps with the previous gate line to form a first overlap region, the area of the first overlap region is S1, a storage capacitance formed by overlapping the first overlap region of the first pixel with the previous gate line is Cst1, a pixel capacitance of the first pixel is Clc1, and a parasitic capacitance formed by the pixel electrode of the first pixel and the current gate line is Cgs1; the voltage values of the first low level and the third low level are V'GL, the voltage value of the high level is VGH, and the voltage value of the second low level is VGL; Cst1=(VGH−VGL)*Cgs1/(VGL−V'GL).

Optionally, a pixel electrode of the second pixel of the pixel group overlaps with a next gate line to form a second overlap region, the area of the second overlap region is S2, a storage capacitance formed by overlapping the second overlap region of the second pixel with the next gate line is Cst2, a pixel capacitance of the second pixel is Clc2, and a parasitic capacitance formed by the pixel electrode of the second pixel and the current gate line is Cgs2; the voltage values of the first low level and the third low level are VGL, the voltage value of the high level is VGH, and the voltage value of the second low level is VGL; Cst2=(VGH−VGL)*Cgs2/(VGL−V'GL).

The present application further discloses a display panel using the driving method, where the display panel includes a plurality of data lines, a plurality of gate lines, and a plurality of pixels; the gate lines are intersected with the data lines, the plurality of pixels is respectively driven by corresponding data lines and gate lines, and each of the plurality of pixels includes a corresponding pixel electrode; a same gate line is connected to two adjacent pixels to form a pixel group, and the pixel group includes a first pixel and a second pixel connected to different data lines; where a pixel electrode of the first pixel of the pixel group overlaps with a previous gate line to form a first overlap region, and a pixel electrode of the second pixel of the pixel group overlaps with a next gate line to form a second overlap region.

Optionally, the gate lines include main gate lines and auxiliary gate lines conducted to each other, and the main gate lines are perpendicular to the auxiliary gate lines.

Optionally, the auxiliary gate lines include first auxiliary gate lines and second auxiliary gate lines, and the first auxiliary gate lines and the second auxiliary gate lines are arranged in parallel.

Optionally, the gate lines include main gate lines and auxiliary gate lines conducted to each other, the main gate lines are intersected with the data lines, and the auxiliary gate lines and the data lines are arranged in parallel.

Optionally, a first safety distance is arranged both between the auxiliary gate line and the corresponding pixel electrode of the first pixel of the current main gate line, and between the auxiliary gate line and the corresponding pixel electrode of the second pixel of the previous main gate line.

Optionally, a second safety distance is arranged between the auxiliary gate line and the corresponding data line.

Optionally, the first auxiliary gate line and the corresponding pixel electrode of the second pixel of the previous main gate line form a first overlap region, and the second auxiliary gate line and the corresponding pixel electrode of the first pixel of the next main gate line form a second overlap region.

Optionally, the area of the first overlap region is S1, and the area of the second overlap region is S2.

The present application further discloses a driving circuit for driving a display panel, and the driving circuit includes: a gate driving circuit configured to output a gate driving signal to a corresponding gate line of the display panel; where a signal period of the gate driving signal output by the gate driving circuit includes a hold time, an open time, and a first pull-down time adjacent to the open time, the gate driving signal is in a first low level within the hold time, the gate driving signal is in a high level at the open time, the gate driving signal is in a second low level within the first pull-down time, and a voltage value of the second low level is lower than a voltage value of the first low level.

Optionally, the first pull-down time is before the open time, a signal period of the gate driving signal further includes a second pull-down time after the open time, the gate driving signal is in a third low level within the second pull-down time, and a voltage value of the third low level is lower than the voltage value of the first low level.

Compared to the solution that the gate driving signal keeps a same level signal input in a period of time, in the present application, a period of each gate driving signal includes three time periods, respectively a hold time, an open time and a first pull-down time; the first pull-down time is adjacent to the open time; the gate driving signal is in a first low level within the hold time, in a high level at the open time, and in a second low level within the first pull-down time; due to the parasitic capacitance Cgs between the gate line and the pixel electrode, when elements are turned off after the pixels are charged, the change of the gate voltage redistributes a liquid crystal capacitance and storage capacitance charge of the pixels through the parasitic capacitance Cgs, so that a kickback phenomenon occurs to the voltage of the charged original pixels; the voltage value of the second low level within the first pull-down time is less than the voltage value of the first low level within the hold time; and the first pull-down time adjusts a kickback voltage generated by the parasitic capacitance generated between the pixel electrode and the gate line, so as to reduce or even eliminate the occurrence of flicker problems.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
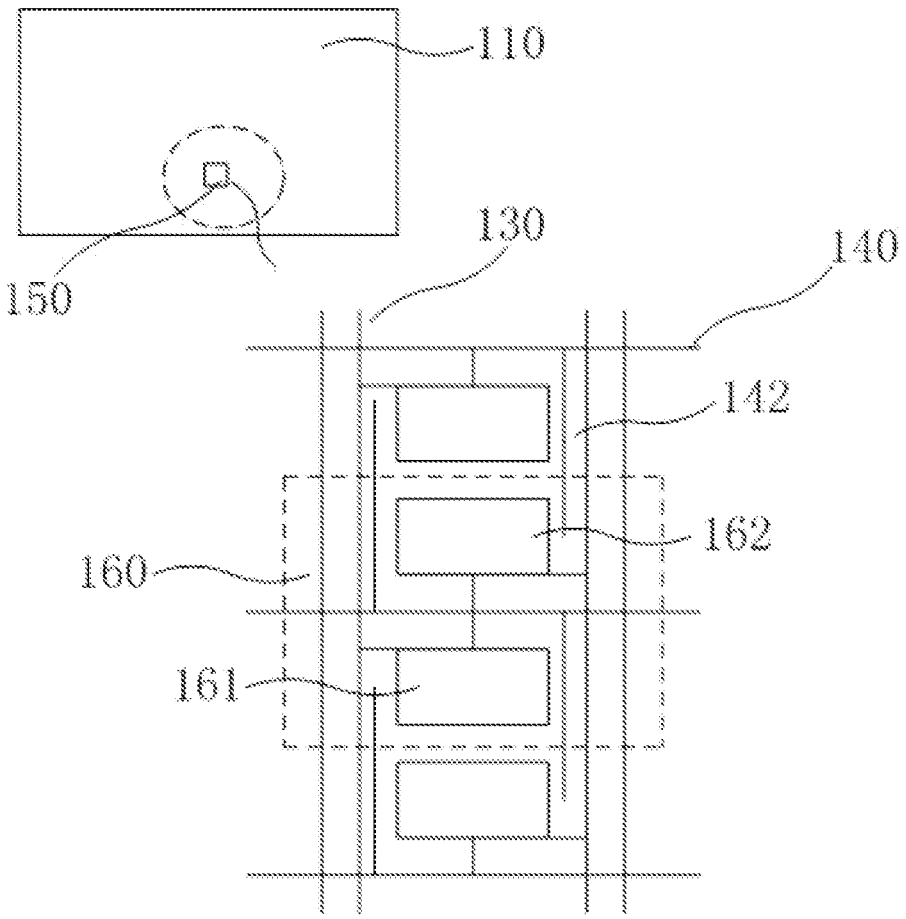
FIG. 1 is an enlarged schematic diagram of pixels of a display panel according to an embodiment of the present application.

It should be understood that the terms used herein and the specific structure and function details disclosed herein are merely representative, and are intended to describe specific embodiments. However, the present application can be specifically embodied in many alternative forms, and should not be interpreted to be limited to the embodiments described herein.

In the description of the present application, the terms such as "first" and "second" are merely for a descriptive purpose, and cannot be understood as indicating a relative importance, or implicitly indicating the number of the indicated technical features. Hence, the features defined by "first" and "second" can explicitly or implicitly include one or more features, and "a plurality of" means two or more, unless otherwise stated. The term "include" and any variations thereof are intended to cover a non-exclusive inclusion, and the presence or addition of one or more other features, integers, steps, operations, elements, components and/or combinations thereof may be possible.

In addition, orientation or position relationships indicated by the terms "center", "transversal", "upper", "lower", "left", "right", "vertical", "horizontal", "top", "bottom", "inner", "outer", etc. are based on the orientation or relative position relationships as shown in the drawings, for ease of the description of the present application and simplifying the description only, rather than indicating that the indicated device or element must have a particular orientation or be constructed and operated in a particular orientation. Therefore, these terms should not be understood as a limitation to the present application.

In addition, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by a person of ordinary skill in the art according to specific circumstances.

The present application is further described below with reference to the accompanying drawings and optional embodiments.

Figure 3:
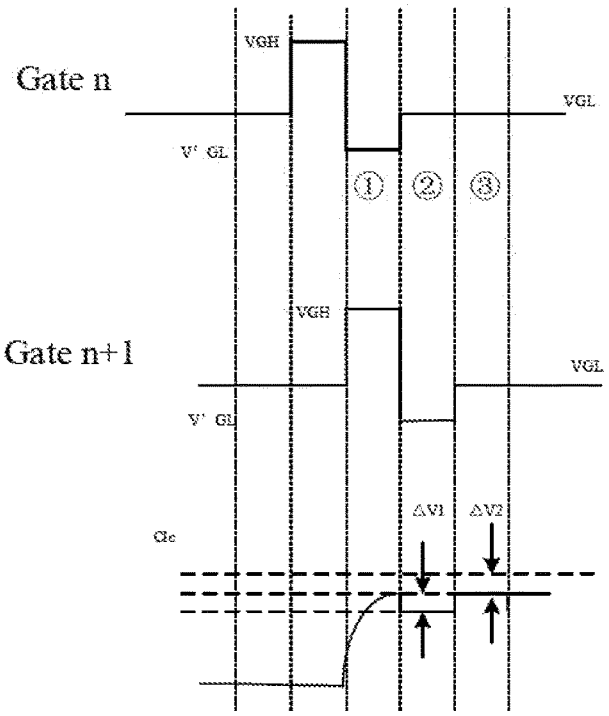
FIG. 3 is a schematic diagram of a driving waveform having only one pull-down time according to an embodiment of the present application.

With reference to FIGS. 1-5, this embodiment discloses a driving method applied to a display panel 110. As shown in FIG. 1, the display panel 110 includes a plurality of data lines 130, a plurality of gate lines 140, and a plurality of pixels 150; the gate lines 130 are intersected with the data lines 140, the plurality of pixels 150 is respectively driven by corresponding data lines 130 and gate lines 140, and each of the plurality of pixels 150 includes a corresponding pixel electrode;

the driving method includes a step of outputting a gate driving signal to a corresponding gate line of the display panel 110;

where a signal period of the gate driving signal includes a hold time, an open time, and a first pull-down time adjacent to the open time; with reference to FIG. 3, the gate driving signal is in a first low level within the hold time, in a high level at the open time, and in a second low level within the first pull-down time, and the second low level is lower than the first low level.

Figure 2:
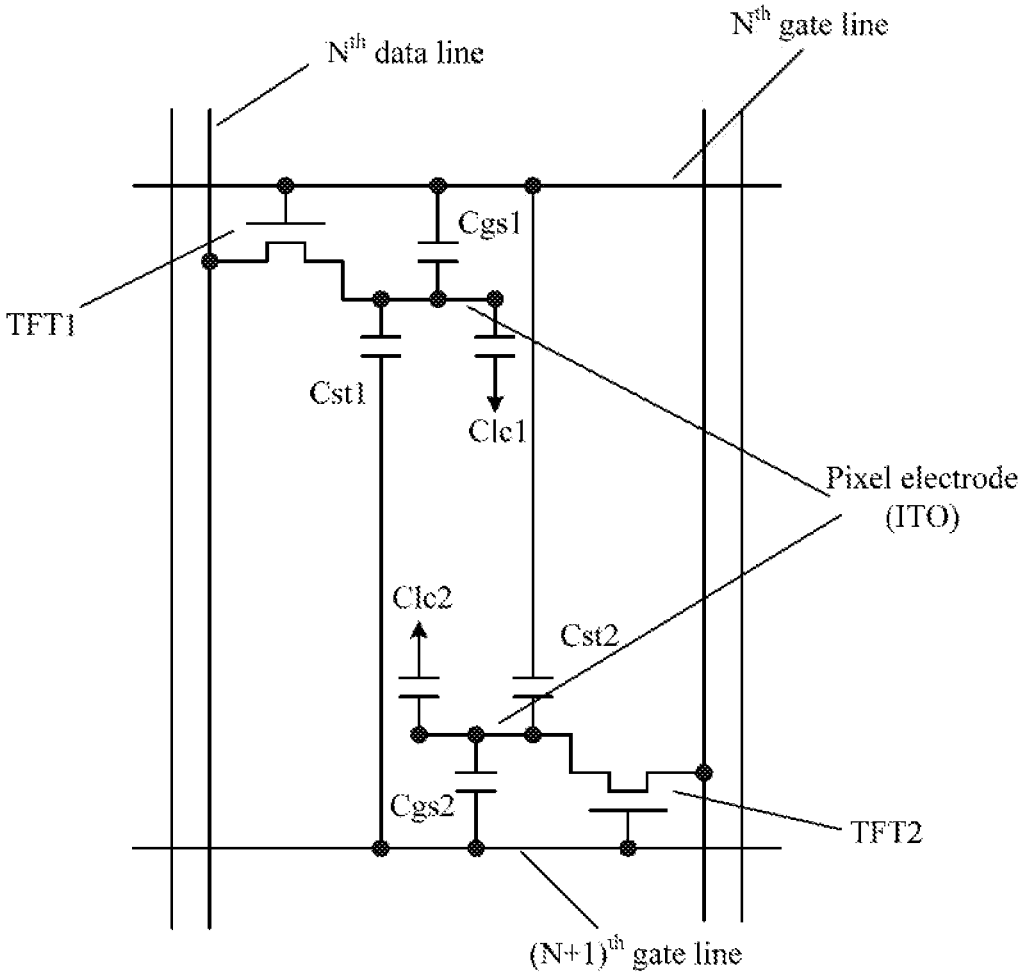
FIG. 2 is a schematic diagram of a pixel structure circuit according to an embodiment of the present application.

In this solution, a period of each gate driving signal includes three time periods, respectively a hold time, an open time and a first pull-down time; the first pull-down time is adjacent to the open time; the gate driving signal is in a first low level within the hold time, in a high level at the open time, and in a second low level within the first pull-down time; with reference to FIG. 2, due to the parasitic capacitance Cgs between the gate line 140 and the pixel electrode, when elements are turned off after the pixels 150 are charged, the change of the gate voltage redistributes a liquid crystal capacitance and storage capacitance charge of the pixels through the parasitic capacitance Cgs, so that a kickback phenomenon occurs to the voltage of the charged original pixels 150; the voltage value of the second low level within the first pull-down time is less than the voltage value of the first low level within the hold time; and in order to lower the value of the kickback value, a kickback voltage generated by the parasitic capacitance generated between the pixel electrode and the gate line 140 is adjusted within the first pull-down time, so as to reduce or even eliminate the occurrence of flicker problems.

Figure 4:
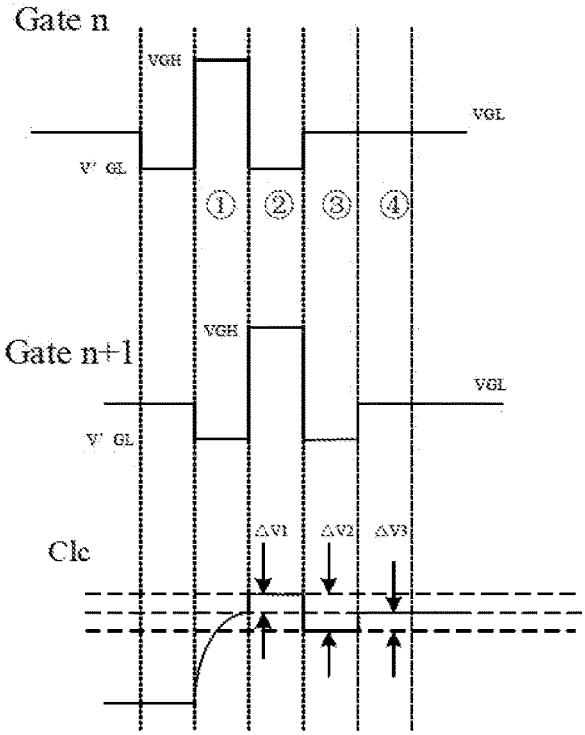
FIG. 4 is a schematic diagram of a driving waveform having two pull-down times according to an embodiment of the present application.

In an embodiment, with reference to FIG. 4, the first pull-down time is before the open time, a signal period of the gate driving signal further includes a second pull-down time after the open time, the gate driving signal is in a third low level within the second pull-down time, and a voltage value of the third low level is lower than the voltage value of the first low level.

In this solution, the parasitic capacitance redistributes a liquid crystal capacitance and storage capacitance charge of the pixels, so that a kickback phenomenon occurs to the voltage of the charged original pixels 150; the gate driving signal is a high level signal within the open time, and is a low level signal within the first pull-down time and the second pull-down time, and voltage values of the low levels are less than a voltage value of the low level within the hold time; and the low levels within two pull-down times are mainly for lowering the kickback voltage, so as to well solve or even eliminate the flicker problems of the display picture caused by the kickback voltage generated by the parasitic capacitance.

In an embodiment, the first pull-down time and the open time are equal in duration; and a gate driving signal of a current gate line 140 corresponds to the first pull-down time when a gate driving signal of a previous gate line 140 corresponds to the open time.

In this solution, the first pull-down time and the open time are equal in duration; a gate driving signal of a current gate line 140 exactly corresponds to the first pull-down time when a gate driving signal of a previous gate line 140 corresponds to the open time; if the durations are not equal, the correspondence cannot be achieved, causing confusion, and a correct loop cannot be formed, causing the display panel 110 to display abnormally.

In an embodiment, the open time and the second pull-down time are equal in duration; and the gate driving signal of the current gate line 140 corresponds to the open time when the gate driving signal of the previous gate line 140 corresponds to the second pull-down time.

In this solution, the gate driving signal of the current gate line 140 corresponds to the open time when the gate driving signal of the previous gate line 140 corresponds to the second pull-down time, to ensure that the open time and the second pull-down time are equal in duration, so as to achieve correspondence between the gate lines 140 to form the correct loop.

In an embodiment, the voltage value of the second low level is equal to the voltage value of the third low level.

In this solution, redistribution generated by the voltage of the parasitic capacitance causes a voltage kickback problem, influencing the picture; the voltage value of the second low level is equal to the voltage value of the third low level; the value of the second low level and the voltage value of the third low level can both adjust the kickback phenomenon to form a more accurate loop, so as to reduce or even eliminate the influence of kickback.

In an embodiment, each pixel 150 includes a pixel electrode, a same gate line 140 is connected to two adjacent pixels 150 to form a pixel group 160, and the pixel group 160 includes a first pixel 161 and a second pixel 162 connected to different data lines 130;

where a pixel electrode of the first pixel 161 of the pixel group 160 overlaps with the previous gate line 140 to form a first overlap region 170, a storage capacitance formed by overlapping the first overlap region 170 of the first pixel 161 with the previous gate line 140 is Cst1, a pixel capacitance of the first pixel 161 is Clc1, and a parasitic capacitance formed by the pixel electrode of the first pixel 161 and the current gate line is Cgs1;

the voltage values of the first low level and the third low level are V'GL, the voltage value of the high level is VGH, and the voltage value of the second low level is VGL;

$$Cst1=(VGH-VGL)*_{Cgs}1/(VGL-VGL).$$

In this solution, with reference to FIG. 4,

At ①, Vpixel=Vdata

At ②, ΔV1=Δ'V+ΔV"1

ΔV'1=(VGH−V'GL)*Cgs1/(Cgs+Cst+Clc)

ΔV"1=(V'GL−VGH)*Cst1/(Cgs+Cst+Clc)

At ③, ΔV2=ΔV'2+ΔV"2

ΔV'2=(V'GL−VGL)*Cgs1/(Cgs+Cst+Clc)

ΔV"2=(VGH−V'GL)*Cst1/(Cgs+Cst+Clc)

At ④, ΔV3=(VGL−VGL)*Cst1/(Cgs+Cst+Clc).

In order to reduce flickers caused by kickback, it is set that Cst1=(VGH−VGL)*Cgs1/(VGL−V'GL), to form a correct loop, eliminate the influence of the kickback voltage and avoid flickers.

Figure 6:
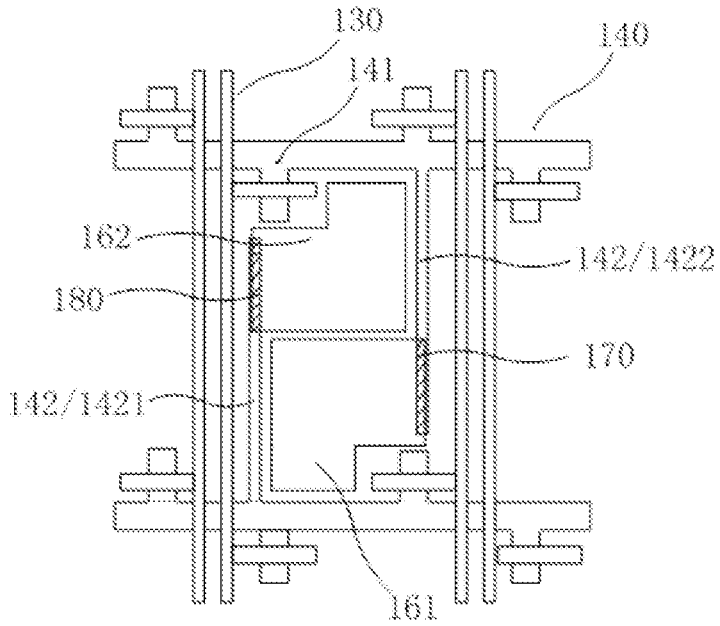
FIG. 6 is a schematic diagram of a pixel structure according to another embodiment of the present application.

In an embodiment, with reference to FIG. 1, each pixel 150 includes a pixel electrode, a same gate line 140 is connected to two adjacent pixels 150 to form a pixel group 160, and the pixel group 160 includes a first pixel 161 and a second pixel 162 connected to different data lines 130;

with reference to FIG. 6, a pixel electrode of the second pixel 162 of the pixel group 160 overlaps with a next gate line 140 to form a second overlap region 180;

a storage capacitance formed by overlapping the second overlap region 180 of the second pixel 162 with the next gate line 140 is Cst2, a pixel capacitance of the second pixel 162 is Clc2, and a parasitic capacitance formed by the pixel electrode of the second pixel 162 and the current gate line is Cgs2;

the voltage values of the first low level and the third low level are V'GL, the voltage value of the high level is VGH, and the voltage value of the second low level is VGL:

$$Cst2=(VGH-VGL)*Cgs2/(VGL-V'GL).$$

Figure 5:
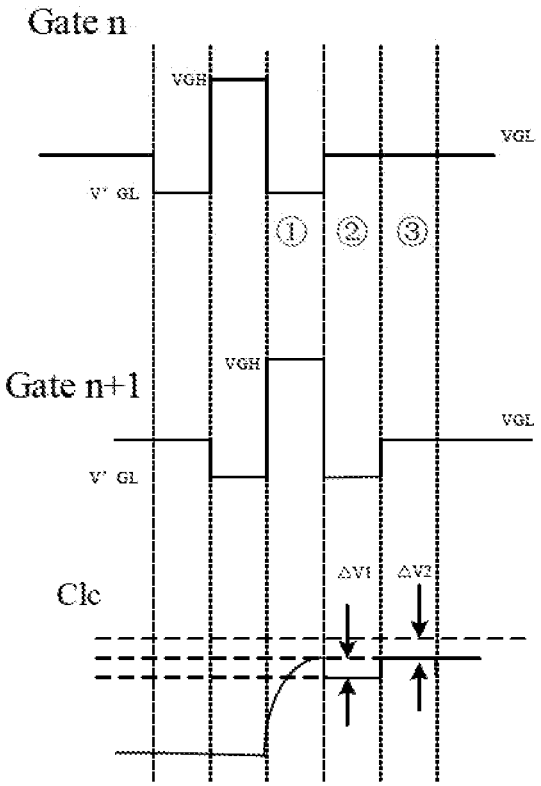
FIG. 5 is a schematic diagram of a driving waveform according to another embodiment of the present application.

In this solution, with reference to FIG. 5,

At ①, Vpixel=Vdata

At ②, ΔV1=ΔV'1+ΔV"1

ΔV'1=(VGH−V'GL)*Cgs2/(Cgs+Cst+Clc)

ΔV"1=(V'GL−VGL)*Cst2/(Cgs+Cst+Clc)

At ③, ΔV2=(VGL−VGL)*Cgs2/(Cgs+Cst+Clc).

In order to reduce flickers caused by kickback, it is set that Cst2=(VGH−VGL)*Cgs1/(VGL−V'GL), to form a correct loop, eliminate the influence of the kickback voltage and avoid flickers.

As shown in FIGS. 1 and 6, as another embodiment of the present application, disclosed is a display panel 110 using the driving method. The display panel 110 includes a plurality of data lines 130, a plurality of gate lines 140, and a plurality of pixels 150; the gate lines 130 are intersected with the data lines 140, the plurality of pixels 150 is respectively driven by corresponding data lines 130 and gate lines 140, and each of the plurality of pixels 150 includes a corresponding pixel electrode; a same gate line 140 is connected to two adjacent pixels 150 to form a pixel group 160, and the pixel group 160 includes a first pixel 161 and a second pixel 162 connected to different data lines 130;

where a pixel electrode of the first pixel 161 of the pixel group 160 overlaps with the previous gate line 140 to form a first overlap region 170, and a pixel electrode of the second pixel 162 of the pixel group 160 overlaps with the next gate line 140 to form a second overlap region 180.

In this solution, two pixels 150 in the pixel group 160 respectively correspond to different data lines 130, so as to ensure the data driving voltage of each pixel 150 and prevent decrease of the data voltage caused by the load of the pixel electrode itself; in addition, the pixel electrodes of different pixels 150 in the pixel group 160 respectively overlap with the previous gate line 140 and the next gate line 140 to form two different storage capacitances; increasing the storage capacitance can reduce the influence of the parasitic capacitance generated by the pixel electrode and the gate line 140, thereby reducing or even eliminating the flicker problem of the display panel 110 caused by the redistribution of the liquid crystal capacitance and the storage capacitance by the parasitic capacitance, and moreover, the aperture rate can be reduced, and the penetration rate of the liquid crystal molecules can be improved, so as to achieve large view-angle color offset.

In an embodiment, the gate lines 140 include main gate lines 141 and auxiliary gate lines 142 conducted to and perpendicular to each other, the auxiliary gate lines 142 include first auxiliary gate lines 1421 and second auxiliary gate lines 1422, the first auxiliary gate line 1421 and the corresponding pixel electrode of the second pixel 162 of the previous main gate line 140 form a second overlap region 180, and the second auxiliary gate line 1422 and the corresponding pixel electrode of the first pixel 161 of the next main gate line 140 form a first overlap region 170; a first safety distance is arranged both between the auxiliary gate line and the corresponding pixel electrode of the first pixel of the current main gate line, and between the auxiliary gate line and the corresponding pixel electrode of the second pixel of the previous main gate line; and a second safety distance is arranged between the auxiliary gate line and the corresponding data line.

In this solution, the auxiliary gate lines 142 extending from the main gate lines 141 and the pixel group 160 form an overlap region; the auxiliary gate lines 142 may have an effect of shielding an electric field; the first auxiliary gate lines and the second auxiliary gate lines are arranged in parallel to the data lines, and a safety distance is arranged, reducing the occurrence of the electric field between the pixel electrode and the data line 130, and also preventing the pixel electrode and the main gate line 141 from generating a stronger parasitic capacitance.

Figure 7:
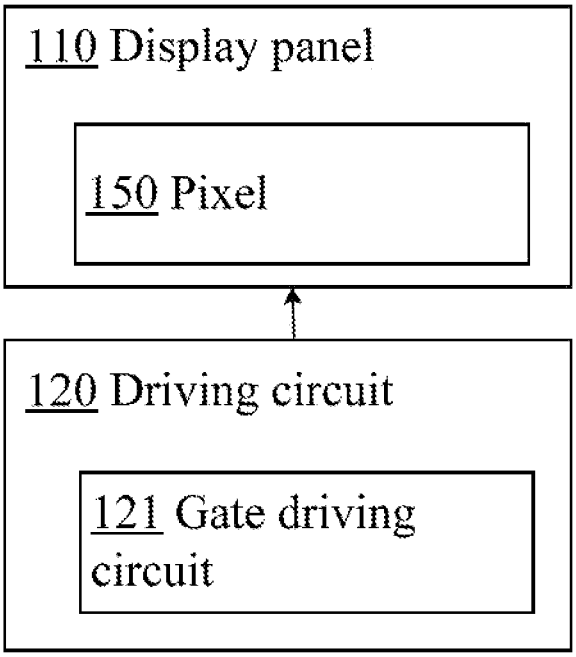
FIG. 7 is a schematic diagram of a driving circuit according to another embodiment of the present application.

As shown in FIGS. 4 and 7, as another embodiment of the present application, disclosed is a driving circuit. The driving circuit drives the display panel 110 as stated above, and includes:

a gate driving circuit 121 configured to output a gate driving signal to a corresponding gate line of the display panel 110;

where a signal period of the gate driving signal output by the gate driving circuit 121 includes a hold time, an open time, and a first pull-down time adjacent to the open time, the gate driving signal is in a first low level within the hold time, in a high level at the open time, and in a second low level within the first pull-down time, and a voltage value of the second low level is lower than a voltage value of the first low level.

In this solution, the driving circuit 120 is configured to drive the display panel 110; the gate driving circuit 121 in the driving circuit 120 outputs a signal to a corresponding gate line of the display panel 110, and outputs a corresponding signal to turn on a corresponding gate line; a period of the gate driving signal is divided into three time periods for respectively outputting different levels; because of the influence of the kickback voltage caused by the parasitic capacitance generated by the pixel electrode and the gate line 140, the voltage pull-down time is set for different time periods to form a correct loop so as to solve the flicker problem caused by the kickback voltage.

Figure 8:
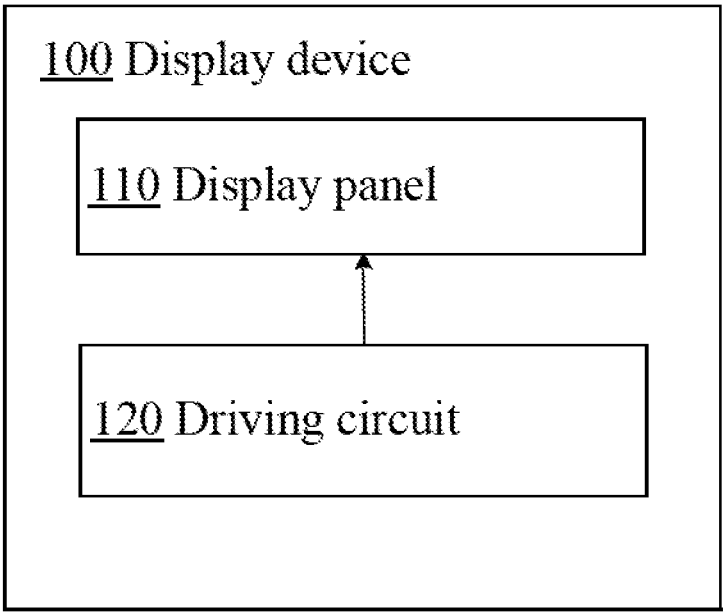
FIG. 8 is a schematic diagram of a display device according to another embodiment of the present application.

As shown in FIG. 8, as another embodiment of the present application, disclosed is a display device 100, including the display panel 110 and a driving circuit 120.

It should be noted that the definitions of steps involved in this solution are not intended to limit the sequence of steps without affecting the implementation of the specific solution. The preceding steps can be executed anteriorly, and can also be executed posteriorly, or even can be executed simultaneously. As long as this solution can be implemented, it should be considered as the scope of protection of the present application.

The technical solution of the present application can be widely applied to various display panels, such as a Twisted Nematic (TN) display panel, an In-Plane Switching (IPS) display panel, a Vertical Alignment (VA) display panel, and a Multi-domain Vertical Alignment (MVA) display panel, and certainly, may also be other types of display panels, such as an OLED display panel, if appropriate.

The contents above are detailed descriptions of the present application in conjunction with optional specific embodiments, and the specific implementation of the present application is not limited to these descriptions. It will be apparent to those skilled in the art that various simple deductions or substitutions may be made without departing from the spirit of the present application, and should be considered to be within the scope of protection of the present application.

What is claimed is:

1. A driving method, applied to a display panel, the display panel comprising:

a plurality of data lines;

a plurality of gate lines intersected with the data lines; and a plurality of pixels respectively driven by corresponding data lines and gate lines, each of the plurality of pixels comprising a corresponding pixel electrode;

the driving method comprises a step of outputting a gate driving signal to a corresponding gate line of the display panel;

wherein a signal period of the gate driving signal comprises a hold time, an open time, and a first pull-down time adjacent to the open time, the gate driving signal is in a first low level within the hold time, the gate driving signal is in a high level at the open time, the gate driving signal is in a second low level within the first pull-down time, and a voltage value of the second low level is lower than a voltage value of the first low level;

wherein the first pull-down time is before the open time, the signal period of the gate driving signal further comprises a second pull-down time after the open time, the gate driving signal is in a third low level within the second pull-down time, and a voltage value of the third low level is lower than the voltage value of the first low level;

wherein the first pull-down time and the open time are equal in duration;

wherein a gate driving signal of a current gate line corresponds to the first pull-down time when a gate driving signal of a previous gate line corresponds to the open time;

wherein the open time and the second pull-down time are equal in duration;

wherein each pixel comprises a pixel electrode, a same gate line is connected to two adjacent pixels to form a pixel group, and the pixel group comprises a first pixel and a second pixel connected to different data lines;

wherein a pixel electrode of the first pixel of the pixel group overlaps a previous gate line to form a first overlap region, the area of the first overlap region is S1, a storage capacitance formed by overlapping the first overlap region of the first pixel with the previous gate line is Cst1, a pixel capacitance of the first pixel is Clc1, and a parasitic capacitance formed by the pixel electrode of the first pixel and the current gate line is Cgs1;

the voltage values of the first low level and the third low level are V'GL, the voltage value of the high level is VGH, and the voltage value of the second low level is VGL;

$$Cst1=(VGH-VGL)*Cgs1/(VGL-V'GL).$$

2. The driving method according to claim 1, wherein the gate driving signal of the current gate line corresponds to the open time when the gate driving signal of the previous gate line corresponds to the second pull-down time.

3. The driving method according to claim 1, wherein the voltage value of the second low level is equal to the voltage value of the third low level.

4. The driving method according to claim 1, wherein a pixel electrode of the second pixel of the pixel group overlaps with a next gate line to form a second overlap region, the area of the second overlap region is S2, a storage capacitance formed by overlapping the second overlap region of the second pixel with the next gate line is Cst2, a pixel capacitance of the second pixel is Clc2, and a parasitic capacitance formed by the pixel electrode of the second pixel and the current gate line is Cgs2;

the voltage values of the first low level and the third low level are V'GL, the voltage value of the high level is VGH, and the voltage value of the second low level is VGL;

$$Cst2=(VGH-VGL)*Cgs2/(VGL-V'GL).$$

5. A display panel, comprising:

a plurality of data lines;

a plurality of gate lines intersected with the data lines; and a plurality of pixels respectively driven by corresponding data lines and gate lines, each of the plurality of pixels comprising a corresponding pixel electrode, a same gate line is connected to two adjacent pixels to form a pixel group, and the pixel group comprises a first pixel and a second pixel connected to different data lines;

wherein a pixel electrode of the first pixel of the pixel group overlaps with a previous gate line to form a first overlap region, and a pixel electrode of the second pixel of the pixel group overlaps with a next gate line to form a second overlap region;

wherein the display panel further comprises a driving circuit for driving the display panel, wherein the driving circuit is configured to output a gate driving signal to a corresponding gate line of the display panel;

wherein a signal period of the gate driving signal comprises a hold time, an open time, and a first pull-down time adjacent to the open time, the gate driving signal is in a first low level within the hold time, the gate driving signal is in a high level at the open time, the gate driving signal is in a second low level within the first pull-down time, and a voltage value of the second low level is lower than a voltage value of the first low level;

wherein the first pull-down time is before the open time the signal period of the gate driving signal further comprises a second pull-down time after the open time, the gate driving signal is in a third low level within the second pull-down time, and a voltage value of the third low level is lower than the voltage value of the first low level;

wherein the first pull-down time and the open time are equal in duration;

wherein a gate driving signal of a current gate line corresponds to the first pull-down time when a gate driving signal of a previous gate line corresponds to the open time;

wherein the open time and the second pull-down time are equal in duration;

wherein the area of the first overlap region is S1, a storage capacitance formed by overlapping the first overlap region of the first pixel with the previous gate line is Cst1, a pixel capacitance of the first pixel is Clc1, and a parasitic capacitance formed by the pixel electrode of the first pixel and the current gate line is Cgs1;

wherein the voltage values of the first low level and the third low level are V'GL, the voltage value of the high level is VGH, and the voltage value of the second low level is VGL;

$$Cst1=(VGH-VGL)*Cgs1/(VGL-V'GL).$$

6. The display panel according to claim 5, wherein the gate lines comprise main gate lines and auxiliary gate lines conducted to each other, and the main gate lines are perpendicular to the auxiliary gate lines.

7. The display panel according to claim 6, wherein the auxiliary gate lines comprise first auxiliary gate lines and second auxiliary gate lines, and the first auxiliary gate lines and the second auxiliary gate lines are arranged in parallel.

8. The display panel according to claim 7, wherein the first auxiliary gate line and the corresponding pixel electrode of the second pixel of the previous main gate line form a first overlap region, and the second auxiliary gate line and the corresponding pixel electrode of the first pixel of the next main gate line form a second overlap region.

9. The display panel according to claim 6, wherein the gate lines comprise main gate lines and auxiliary gate lines conducted to each other, the main gate lines are intersected with the data lines, and the auxiliary gate lines and the data lines are arranged in parallel.

10. The display panel according to claim 9, wherein a first safety distance is arranged both between the auxiliary gate line and the corresponding pixel electrode of the first pixel of the current main gate line, and between the auxiliary gate line and the corresponding pixel electrode of the second pixel of the previous main gate line.

11. The display panel according to claim 9, wherein a second safety distance is arranged between the auxiliary gate line and the corresponding data line.

12. A driving circuit for driving a display panel, the display panel comprising:

a plurality of pixels formed by a plurality of data lines intersecting a plurality of gate lines;

each of the plurality of pixels comprises a pixel electrode;

a same gate line is connected to two adjacent pixels to form a pixel group, and the pixel group comprises a first pixel and a second pixel connected to different data lines;

wherein a pixel electrode of the first pixel of the pixel group overlaps with a previous gate line to form a first overlap region, and a pixel electrode of the second pixel of the pixel group overlaps with a next gate line to form a second overlap region;

the driving circuit comprises:

a gate driving circuit configured to output a gate driving signal to a corresponding gate line of the display panel;

wherein a signal period of the gate driving signal output by the gate driving circuit comprises a hold time, an open time, and a first pull-down time adjacent to the open time, the gate driving signal is in a first low level within the hold time, the gate driving signal is in a high level at the open time, the gate driving signal is in a second low level within the first pull-down time, and a voltage value of the second low level is lower than a voltage value of the first low level;

wherein the first pull-down time is before the open time, the signal period of the gate driving signal further comprises a second pull-down time after the open time, the gate driving signal is in a third low level within the second pull-down time, and a voltage value of the third low level is lower than the voltage value of the first low level;

wherein the first pull-down time and the open time are equal in duration;

wherein a gate driving signal of a current gate line corresponds to the first pull-down time when a gate driving signal of a previous gate line corresponds to the open time;

wherein the open time and the second pull-down time are equal in duration;

wherein the area of the first overlap region is S1, a storage capacitance formed by overlapping the first overlap region of the first pixel with the previous gate line is Cst1, a pixel capacitance of the first pixel is Clc1, and a parasitic capacitance formed by the pixel electrode of the first pixel and the current gate line is Cgs1;

the voltage values of the first low level and the third low level are V'GL, the voltage value of the high level is VGH, and the voltage value of the second low level is VGL:

$$Cst1=(VGH-VGL)*Cgs1/(VGL-V'GL).$$

* * * * *